United States Patent [19]

Kataoka

[11] Patent Number: 4,609,162

[45] Date of Patent: Sep. 2, 1986

[54] SHEET WINDING APPARATUS

[76] Inventor: Hiroshi Kataoka, 3686 Samukawacho, Iyo-Mishima-shi, Ehime-ken, Japan

[21] Appl. No.: 683,515

[22] Filed: Dec. 19, 1984

[30] Foreign Application Priority Data

Dec. 23, 1983 [JP] Japan ..... 58-241880

[51] Int. Cl.[4] ..... B65H 18/16

[52] U.S. Cl. ..... 242/56 R; 242/65

[58] Field of Search ..... 242/65, 56 R

[56] References Cited

U.S. PATENT DOCUMENTS

| | | | |
|---|---|---|---|
| 2,777,644 | 1/1957 | Nicholson | 242/65 |
| 3,198,453 | 8/1965 | Aaron | 242/65 |
| 3,494,566 | 2/1970 | Pawelczyk | 242/65 |
| 3,586,253 | 6/1971 | Gilbank | 242/65 |
| 3,610,545 | 10/1971 | Reifenhauser | 242/65 X |
| 4,026,487 | 5/1977 | Ales | 242/65 |
| 4,049,212 | 9/1977 | Yamaguchi et al. | 242/65 X |
| 4,390,138 | 6/1983 | Rohde et al. | 242/65 X |

FOREIGN PATENT DOCUMENTS

| | | | |
|---|---|---|---|
| 2010072 | 9/1971 | Fed. Rep. of Germany | 242/65 |

*Primary Examiner*—John M. Jillions

*Attorney, Agent, or Firm*—Oblon, Fisher, Spivak, McClelland & Maier

[57] ABSTRACT

A sheet winding apparatus having stationary type touch roller is provided with means for moving a winding core between a sheet winding position and a sheet roll waiting position. Whenever a strip of sheet is wound in a roll of prescribed amount on the winding core, the finished sheet roll is moved to the sheet roll waiting position and, in the meantime, a new winding core is supplied and the sheet of the aforementioned finished sheet roll is cut at the trailing end and the newly formed leading end of the sheet is attached to the new winding core. The winding of the sheet on the new winding core is started as soon as the winding core supporting means returns to the winding position.

3 Claims, 7 Drawing Figures

SHEET WINDING APPARATUS

BACKGROUND OF THE INVENTION

1. Field of the Invention

This invention relates to a sheet winding apparatus, and more particularly to a sheet winding apparatus of the type having a stationary touch roller, which apparatus permits a sheet roll wound to a prescribed total amount to be moved from the winding position, cuts the trailing end of the sheet roll, wraps the cut end of the sheet around a new winding core set in the winding position, and starts winding the sheet on the new winding core.

2. Description of the Prior Art

Generally a sheet winding apparatus is used to produce sheet rolls by causing a given strip of sheet unwound from a master sheet roll or discharged from a production process or fabrication process to be wound in rolls of prescribed amounts on one winding shaft after another. The strip of sheet, when necessary, may be slit into a plurality of strips of a fixed width en route to the winding apparatus.

In the sheet winding apparatus, whenever the sheet has been wound up in a roll of prescribed amount, there must be performed the operations of cutting the trailing end of the sheet of the wound sheet roll, moving the finished sheet roll from the winding position to the sheet roll discharging position, setting a new winding core in place on a winding core support part of a winding mechanism, wrapping the cut leading end of the sheet around the new winding core, and moving the winding core to the winding starting position at which the winding core comes into contact with a touch roller.

As means of automatically performing all the operations mentioned above, a turret type winding apparatus has been developed and adopted for actual use (U.S. Pat. Nos. 3,734,423 and 3,784,122). This turret type winding apparatus has a plurality of positions for holding a winding core formed around the periphery of the turret type frame, so that the winding of the sheet will be effected continuously and automatically by allowing the work of removing a finished sheet roll to take place at one position and the work of setting a new winding core at another position while enabling sheet winding to continue at yet another position. This turret type winding apparatus permits continuous winding of the sheet and enjoys high operational efficiency. It nevertheless has a disadvantage in that it requires a complicated mechanism and requires a large space for installation and operation. Moreover, it inevitably requires a touch roller of a movable type for keeping the sheet against the winding core during the course of the sheet winding. The expression "movable type touch roller" as used in this specification means the type in which the winding shaft for supporting a winding core is fixed in place and, as the diameter of the roll gradually increases with the progress of the sheet winding, the touch roller is gradually moved away from th winding core, whereas the expression "stationary type touch roller" means the type in which the touch roller is supported on a fixed shaft and the winding shaft supporting thereon a winding core is disposed on the periphery of the touch roller and, as the diameter of the sheet roll grows with the progress of the sheet winding, the winding shaft is gradually moved away from the touch roller.

In the winding apparatus, the touch roller plays an important role in enabling the sheet to be accurately wound in a roll with prescribed tension. To be specific, the touch roller is rotated by being interlocked through the medium of a fine rotation speed adjusting mechanism with the rotary drive mechanism of the unwinding roller serving to advance the sheet toward the winding apparatus, so that the peripheral speed of the touch roller will be adjusted relative to the peripheral speed of the unwinding roller. Owing to this adjustment, the tension of the sheet on the verge of reaching the growing roll can be adjusted to the optimum level even when the tension of the sheet discharged from the unwinding roller happens to exceed or fall short of the optimum level. Since the sheet of properly adjusted tension is immediately wound on the winding core which is centrally driven with a prescribed amount of torque, the winding tension can be controlled with high precision, and the sheet can be wound under the optimum tension. The touch roller of this operating principle, therefore, proves particularly advantageous for the winding of a strip of sheet such as woven fabric whose wefts are liable to slide sideways while the fabric is being wound in a roll.

As described above, the touch roller is required to be interlocked with the unwinding roller and kept rotated with the rotational speed thereof finely adjusted at all times. In the case of the movable type touch rollers, however, since the touch roller is constantly in motion, it is difficult to transmit the finely adjusted rotational speed accurately to the touch roller and keep the touch roller in stable rotation.

For the purpose of accurate rotation of the touch roller, the touch roller of the stationary type proves advantageous over that of the movable type as described above. In the conventional sheet winding apparatus of the type using no turret type frame, since only one position is used for the attachment of the winding shaft, continuous, automatic sheet winding cannot be performed, and the operation of moving and discharging a finished sheet roll, that of setting a new winding core, and that of wrapping the cut leading end of sheet around the winding core have to be carried out manually.

OBJECTS OF THE INVENTION

An object of this invention is to provide a sheet winding apparatus of the type using a stationary touch roller, which apparatus permits automatic winding of the sheet.

Another object of this invention is to provide a sheet winding apparatus which permits the rotational speed of the touch roller to be finely adjusted easily relative to the rotational speed of the unwinding roller and enables the sheet to be wound up under the optimum sheet tension at all times.

SUMMARY OF THE INVENTION

This invention concerns a sheet winding apparatus provided with a stationary touch roller. Specifically, this sheet winding apparatus comprises a winding core for winding thereon a sheet, winding core supporting means for supporting the aforementioned winding core in place, means for moving the aforementioned winding core supporting means between a sheet winding starting position and a sheet roll waiting position, means for supplying a new winding core to the aforementioned sheet winding starting position while the aforementioned winding core supporting means is kept at the sheet roll waiting position, and a cutter for cutting the sheet at the trailing end of the finished sheet roll and attaching the newly formed leading end of the sheet to the new winding core. In this construction, whenever a sheet roll is finished, this sheet roll is moved to the sheet roll waiting position. In the meantime, a new winding core is supplied to the sheet winding starting position, the sheet of the finished sheet roll is cut at the trailing end, and the newly formed leading end of the sheet is attached to the new winding core. When the sheet roll on the winding core supporting means is moved, the winding core supporting means immediately returns to the sheet winding starting position, catches hold of the new winding core, and starts winding a new sheet roll. The sheet winding apparatus of this invention, therefore, provides a notable improvement in the efficiency of winding operation, permits the sheet winding to be carried out automatically and safely, and saves considerable labor.

The other objects and characteristics of the present invention will become apparent to those skilled in the art as the disclosure is made in the following description of a preferred embodiment of the invention, as illustrated in the accompanying drawings.

DESCRIPTION OF PREFERRED EMBODIMENTS

Figure 1:
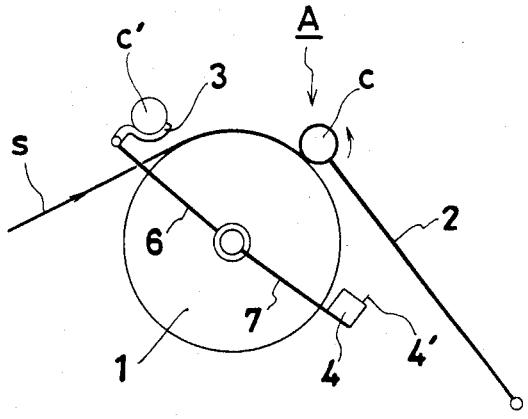
FIG. 1 is an explanatory diagram for illustrating the condition in which sheet winding is started in a sheet winding apparatus of the present invention.
Figure 2:
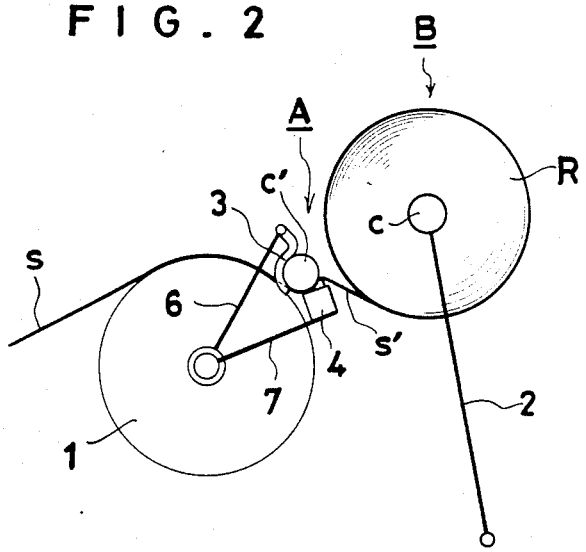
FIG. 2 is an explanatory diagram for illustrating the condition in which the sheet has been fully wound up in a roll and the sheet is on the verge of being wound on a new winding core.
Figure 3:
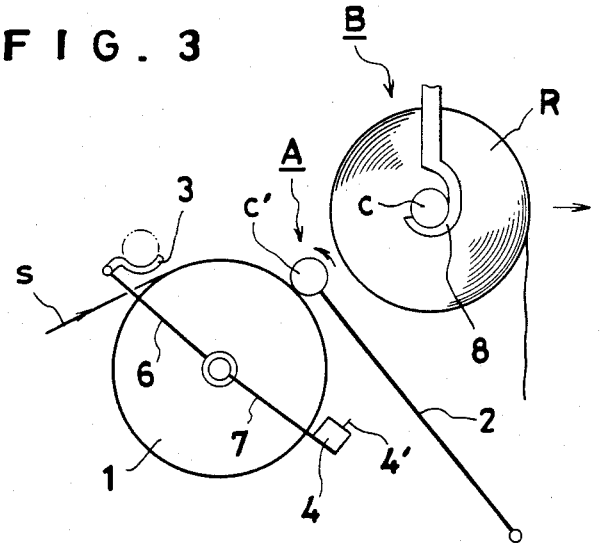
FIG 3 is an explanatory diagram for illustrating the condition in which the sheet winding on the new winding core is started.

FIGS. 1–3 are explanatory diagrams for illustrating the operation of the sheet winding apparatus of this invention, 1 denoting a stationary type touch roller, "A" a sheet winding starting position and "B" a sheet roll waiting position.

A winding core c, at the winding starting position "A", is supported by a winding core supporting member 2 so as to be held in contact with the touch roller 1 under suitable pressure and consequently allowed to wind thereon a sheet s brought in from a suitable source (FIG. 1). The sheet to be wound is not limited to a sheet from a master roll (not shown). A sheet from a fabrication line can also be wound up effectively. The sheet is advanced through an unwinding roller (not shown) toward the sheet winding apparatus.

After the sheet has been wound on the winding core c to produce a roll of a prescribed amount, the discharge of the sheet from the unwinding roller is suspended, the winding core supporting member 2 is moved from the sheet winding position "A" to the sheet roll waiting position "B", and the sheet roll R is separated from the touch roller 1. To the sheet winding starting position "A" so evacuated of the sheet roll, a winding core receiver 3 supporting thereon a new winding core c′ and a sheet cutter 4 provided at the leading end thereof with a blade 4′ are moved from their respective waiting positions. In the illustrated embodiment, the winding core receiver 3 is pivotally supported on a rotary arm 6 disposed coaxially with the touch roller 1. From the waiting position above the incoming path of the sheet s, the winding core receiver 3 moves about the upper periphery of the touch roller 1 and reaches the winding starting position "A". In the meantime, the sheet cutter 4 is supported by a rotary arm 7 disposed coaxially with the touch roller 1. From the waiting position substantially opposed by about 180° to the waiting position of the winding core receiver, the sheet cutter 4 is moved about the lateral periphery of the touch roller 1 substantially at the same time that the winding core receiver is moved. On reaching the winding starting position "A", the sheet cutter 4 presses with its own blade 4′ the sheet s′ held taut under the pressure of the new winding core against the new winding core c′ and cuts it (FIG. 2). The winding core c′ has adhesive agent applied in advance on the outer peripheral surface, so that the surface of the leading end of the sheet newly formed by the cutting adheres to the new winding core c′. It is, of course, permissible to provide the sheet cutter with a spray adapted to spurt water or adhesive agent at the moment the sheet is cut so as to enable the newly cut leading end of the sheet to adhere to the winding core.

While the sheet of the finished sheet roll is cut at the trailing end and the newly formed leading end of the sheet is attached to the winding core at the sheet winding starting position "A", the sheet roll R located at the sheet roll waiting position "B" is caught at the opposite ends of the winding core c slightly protruding from the sheet roll R by crane hooks 8 (see FIG. 3) moved in downwardly or sideways and lifted and moved to the transporting position. Otherwise, the sheet roll R may be directly released onto a truck or onto the floor.

When the sheet roll R is suspended by the crane hooks 8, the winding core supporting member 2 immediately returns to the winding starting position "A", catches hold of the winding core c′ having the newly formed leading end of the sheet attached fast thereto, and brings the winding core c′ into contact with the touch roller 1. When the winding core receiver 3 and the sheet cutter 4 return to their respective waiting positions (FIG. 3), the winding core supporting member 2 starts unwinding the sheet s and winding it on the new winding core c′.

Figure 4:
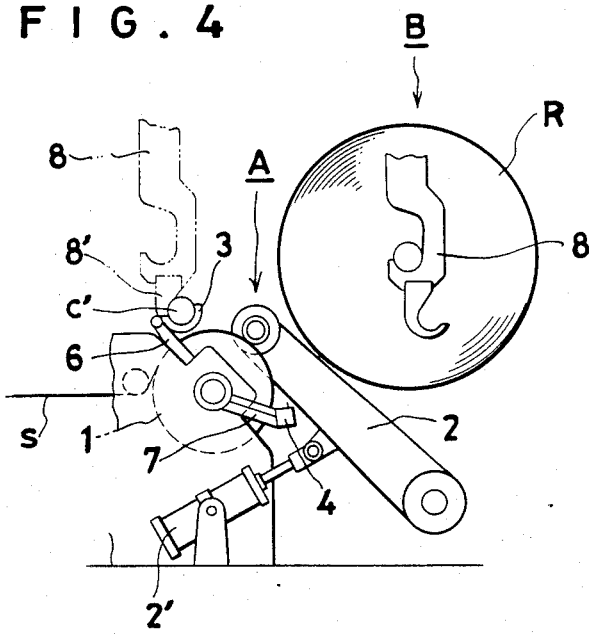
FIG. 4 is a schematic front view illustrating the components in FIGS. 1–3 in their actual shapes.

Supply of a winding core to the winding core receiver 3 held at the waiting position can be effectively carried out by fitting auxiliary hooks 8′ on the crane hooks 8 for suspending the sheet roll as shown in FIG. 4, mounting a new winding core on the auxiliary hooks 8′, delivering the new winding core to the winding core receiver at the waiting position, then keeping the crane hooks 8 waiting near the sheet roll waiting position "B" and, after the completion of the movement of the finished sheet roll to its own waiting position, lowering the winding core receiver onto the waiting position. Of course, the supply of the winding core may be carried out either manually or by some other suitable means.

In the conventional sheet winding apparatus, when a sheet roll is fully wound up, the sheet is cut at the trailing end, the finished sheet roll on the winding core supporting member is moved as by means of crane hooks to the transporting position, a new winding core is mounted on the winding core supporting member, and the winding core supporting member is returned to the winding starting position, the newly formed leading end of the sheet is attached to the new winding core as with an adhesive tape, and thereafter the sheet winding on the new winding core is started. In the sheet winding apparatus of the present invention, while the finished sheet roll is being moved as with a crane or a lift wheel to the transporting mechanism, the newly formed leading end of the sheet is attached to the new winding core at the sheet winding starting position and the winding core waits for the return of the winding core supporting member. Thus, the sheet winding is started immediately when the winding core supporting member returns to the winding starting position and catches hold of the winding core. Thus, this apparatus enjoys high efficiency of operation. Particularly, the sheet roll waiting position has only to be separated from the winding starting position by a distance such that when the sheet roll is moved, the gap to be formed between the peripheral surface of the sheet roll and that of the touch roller will be large enough to permit interposition of a new winding core therein. Since the distance so separating the two positions is relatively small, the efficiency of winding operation enjoyed by the apparatus of this invention is favorably comparable with that of the turret type sheet winding apparatus.

Depending on the structure of the winding core supporting member, not merely the winding core supporting member but also the stationary touch roller is able to bear a part of the weight of the sheet roll. In this case, therefore, the apparatus is capable of stably winding a sheet roll of larger width and larger diameter and consequently greater weight.

FIG. 4 depicts the components of the apparatus illustrated in the explanatory diagrams of FIGS. 1–3 in their actual shapes.

Figure 5:
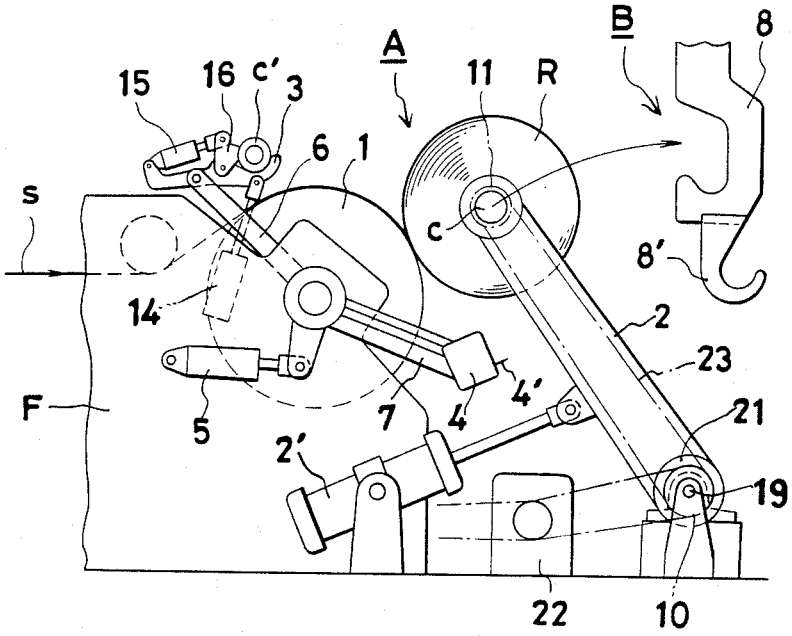
FIG. 5 is a front view of the essential parts of a sheet winding apparatus in one embodiment of this invention.
Figure 6:
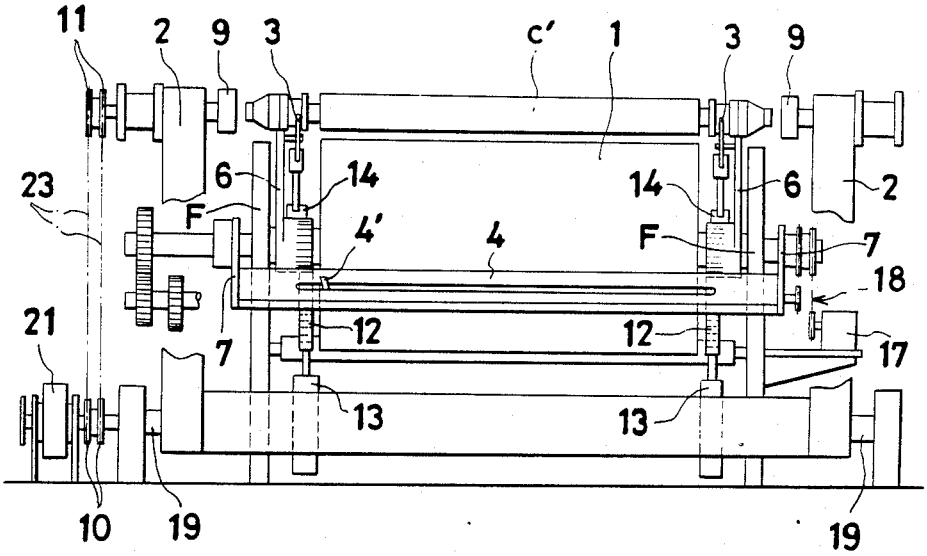
FIG. 6 is a side view of the sheet winding apparatus of FIG. 5.

FIGS. 5–6 represent a sheet winding apparatus according to the present invention. The touch roller 1 fixed to a frame base F is rotated by being interlocked via a fine speed varying mechanism to the rotary drive mechanism of an unwinding roller (not shown) serving to advance the sheet s toward the sheet winding apparatus. (The rotary drive mechanism of the touch roller is also not shown.) Since the peripheral speed of the touch roller 1 can be adjusted relative to the peripheral speed of the unwinding roller owing to the presence of the fine speed varying mechanism, the tension of the strip of sheet on the verge of reaching the touch roller 1 or the growing roll of sheet is adjusted to the optimum level even when the tension happens to exceed or fall short of the optimum level at the unwinding roll. Then, the sheet is wound up on the winding core c which is kept centrally driven with a prescribed amount of torque. This adjustment of the tension of the sheet may be effected through the medium of a spring clutch in place of the aforementioned fine speed varying mechanism. The winding core supporting member 2 which serves to keep the winding core c in contact with the touch roller 1 under prescribed pressure of contact is formed in the present embodiment of one pair of arm members 2. The pair of arm members 2 are provided on the inner sides of the leading ends thereof with chucks 9 adapted to nip the winding core c. The bases of the arm members are supported by fulcrums 19 in such a manner that they will be rotated about the fulcrums 19 as separated by a prescribed distance from each other. To the arm members are connected hydraulic cylinders 2' which are adapted to adjust the pressure of contact of the touch roller 1 to the winding core c during the progress of sheet winding. After the sheet is wound in a finished roll, the arm members 2 are moved from the winding position "A" to the sheet roll waiting position "B". The fulcrums 19 are provided at one end thereof with electromagnetic powder clutches 21. The rotary driving force generated by a speed variable motor or a speed change gear 22 is transmitted through a chain wheel 10 provided on the output shaft of the electromagnetic powder clutch 21, a chain 23, and a chain wheel 11 disposed coaxially with a chuck 9 disposed at the leading end of the arm members 2 to the winding core c. Although the electromagnetic powder clutch 21 is provided for the purpose of adjusting the winding torque, a motor may be adopted to impart driving force directly to the winding core.

The winding core receiver 3 stands waiting above the sheet advancing path of the touch roller as described above. The mechanism for the movement to the winding starting position is formed of the rotary arm 6 adapted to rotate coaxially with the touch roller 1, a rack bar 12 adapted to rotate the toothed wheel (not shown) at the boss of the rotary arm accurately by a fixed angle, a hydraulic cylinder 13 serving to drive the aforementioned rack bar 12, and a hydraulic cylinder 14 adapted to cause the winding core receiver 3 pivotally supported on the leading end of the rotary arm 6 to be rotated about the pivotal point as the center and keep the winding core c' pressed on the peripheral surface of the touch roller 1 at the winding starting position "A". The new winding core c' to be supplied to the winding core receiver 3 is held in place by a cylinder 15 and a clamp 16 (FIG. 5).

The crane hooks 8 for feeding the winding core c' in advance to the winding core receiver 3 possesses upper and lower hooks. The upper hooks are adapted to catch hold of thick portions of the winding core c protruding from the opposite end faces of the sheet roll R and the lower hooks 8' are adapted to take hold of rather thin portions at the opposite ends of the winding core c'. The upper hooks and the lower hooks are pointed in opposite directions because the direction in which the crane hooks 8 are moved toward receiving the sheet roll R and the direction in which the winding core c' is lowered toward the receiver 3 are opposite each other.

The sheet cutter 4 is formed of a beam disposed in parallel to the axial direction of the touch roller and a pair of rotary arms 7 having the bases thereof pivotally supported coaxially with the touch roller and having the leading ends thereof serving to retain the aforementioned beam in place. The beam in the present embodiment consists of an angular tube possessing a slit. The interior of this beam is so designed that a sliding member having only the blade 4' projecting out of the slit will be moved freely therein. The sliding member is driven inside the beam by means of a motor 17 and driving means 18. The movement of the beam from the waiting position at the leading end of the arm to the sheet winding starting position is effected by means of a hydraulic cylinder 5 (FIG. 5).

In the sheet winding apparatus constructed as described above, the winding core is supported in place at the sheet winding starting position by the chuck 9 provided at the leading end of the pair of arm members 2 and starts winding the sheet, with the pressure of contact of the winding core against the touch roller 1 adjusted to a prescribed magnitude by the cylinder 2'. At this time, the rotary drive mechanism of the unwinding roller and that of the touch roller are interlocked to each other through the medium of the fine speed varying mechanism in such a manner that the tension of the sheet discharged from the unwinding roller is adjusted by the touch roller to the optimum level on the verge of being wound on the winding core even when the tension of the sheet happens to exceed or fall short of the optimum level at the discharge side. Consequently, the sheet is wound by the winding core which is rotated at a prescribed amount of torque.

During the sheet winding described above, the lower hooks 8' take hold of a new winding core, and the crane hooks 8 are moved to supply the winding core to the winding core receiver 3 kept waiting above the sheet advancing path of the touch roller. Then, the crane is moved further to the sheet roll waiting position "B".

When the sheet is wound on the winding core to a prescribed total amount, the rotation of the unwinding roller, touch roller, and winding core is suspended and the cylinder 2' is actuated to move the sheet roll formed at the leading ends of the arm members 2, with the sheet retained in its continuous (non-severed) state, to the roll waiting position. Then the winding core protruding from the opposite ends of the roll is hung down from the upper hooks of the crane kept waiting there. At the same time that the arm members are moved, the winding core receiver 3 and the sheet cutter 4 are sped by their respective moving mechanisms to the sheet winding starting position from opposite directions. The sheet which continues into the sheet roll and is consequently kept taut is cut at the trailing end. The newly formed leading end of the sheet is attached by suitable means to the new winding core kept in place by the winding core receiver.

When the roll sheet is hung from the crane hooks 8, the chucks 9 of the arm members 2 are actuated to release the winding core. Then, the cylinder 2' is actuated to return the arm members to the sheet winding position and cause the chucks to take hold of the winding core having the cut leading end of the sheet attached thereto. After the winding core receiver and the sheet cutter are returned to their respective waiting positions, the unwinding roller, the touch roller, and the winding core are again set rotating to start the sheet winding.

Figure 7:
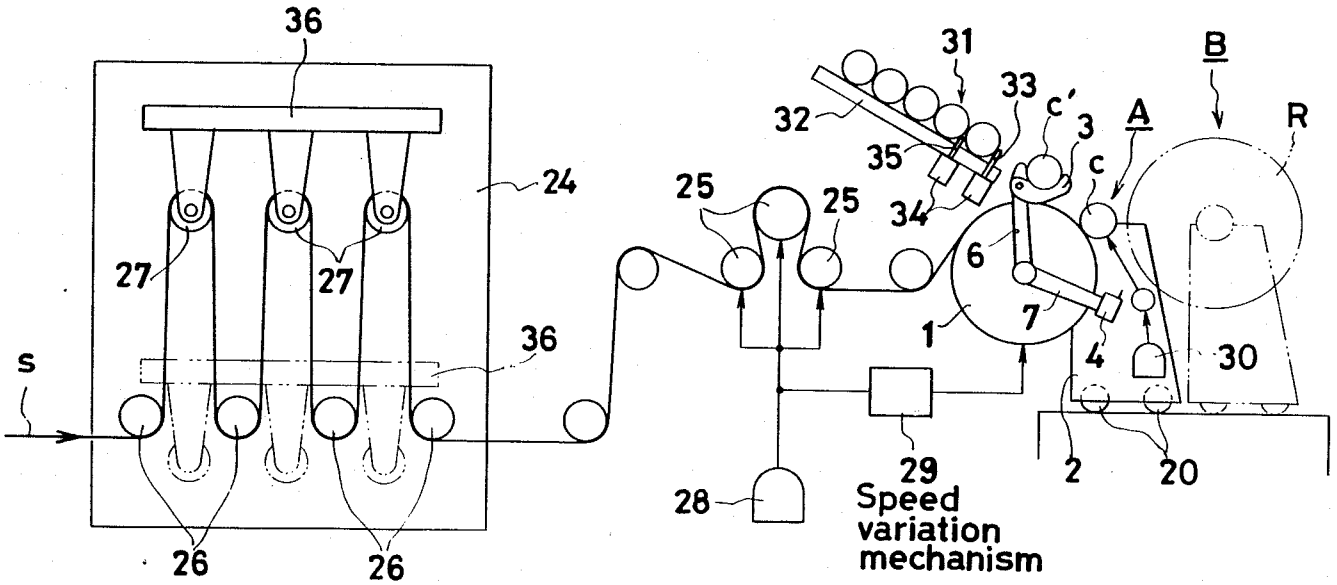
FIG. 7 is a side view illustrating another sheet winding apparatus embodying this invention.

FIG. 7 illustrates another sheet winding apparatus embodying this invention. The sheet s which is continuously advanced toward the sheet winding apparatus is passed through an accumulator 24, drawn forward by unwinding rollers 25, pressed constantly by the peripheral surface of the touch roller 1, and finally wound on the winding core c. Within the accumulator 24, rollers 26 are of the stationary type and rollers 27 are fixed to an elevating frame 36. While the sheet winding is in process, the rollers 27 are kept waiting at the positions indicated by the chain line. While the sheet winding is suspended, the rollers 27 are elevated in conjunction with the elevating frame 36 and the accumulator 24 functions to store the incoming sheet. When the sheet winding is resumed, the accumulator 24 releases the stored sheet and the elevating frame 36 and the rollers 27 descend and return to the original positions indicated by the chain line.

The unwinding rollers 25 may be replaced with pinching rollers. In this case, the pinching rollers are disposed so as to increase the sheet wrapping angle and are driven by the rotation generated by an unwinding motor 28. In the meantime, the touch roller which is supported in place by opposed frames is driven by the rotation generated by the same unwinding motor 28 in such a manner that the peripheral speed of the touch roller is allowed to be slightly varied by a prescribed amount relative to the peripheral speed of the unwinding roller through the medium of a speed variation mechanism 29.

The winding core, similarly to the embodiment described above, is driven by the rotation by a motor 30 at a winding speed synchronized with the speed of the unwinding roller (not shown). In this embodiment, the winding core is operated to wind the sheet as supported on the winding core supporting member which is adapted to move while retaining a straight form toward and away from the touch roller and is provided in the bottom part thereof with moving means 20. Further in the present sheet winding apparatus, winding cores to be used subsequently are kept stored in a winding core supply unit 31 disposed above the touch roller 1. When the winding core receiver delivers a winding core to the winding core supporting member and then returns to its waiting position prior to the start of the sheet winding, the next winding core is automatically discharged from the winding core supplying unit 31 and received by the winding core receiver 3. In the present embodiment, the winding core supplying unit 31 is so constructed that a multiplicity of winding cores are arrayed on an inclined holder base 32. A stopper 33 disposed at the leading end of the holder base 32 prevents the supply of winding cores from falling down the holder base 32. When supply of one winding core is needed, hydraulic cylinders 34 are operated to actuate a stopper 35 disposed behind the foremost one of the winding cores and to release the foremost winding core alone onto the winding core receiver 3. When this delivery is completed, the stopper 33 is again raised from the holder base, and the stopper 35 is retracted under the holder base 32 to advance the train of winding cores until it collides against the stopper 33.

The sheet winding apparatus of this invention has been described with reference to two preferred embodiments. Obviously, many modifications and variations of the present invention are possible in light of the foregoing teachings. It is therefore to be understood that within the scope of the appended claims, the present invention may be practiced otherwise than as specifically described herein.

For example, the winding core may instead be supported by a cantilever type supporting member. The various drive mechanisms may be powered by motors in place of hydraulic devices. The winding core retaining mechanism of the winding core receiver may be adapted to be operated with electromagnetic force. The sheet cutter may be a knife, a circular blade, a sawtooth blade, or a heat-ray welder.

The winding core for which the winding core supporting member is used may be a shaft bar inserted in a core tube, a plain shaft bar used by itself, or a core tube held fast in place with the opposite ends thereof set in retainer cups. The winding core may be retained in place as nipped at the opposite ends or supported pivotally.

As is clear from the foregoing description, since the sheet winding apparatus of this invention uses a stationary type touch roller, it enjoys an advantage that it is compact in size and simple in mechanism as compared with the conventional turret type automatic sheet winding apparatus. It permits the sheet winding to be performed automatically with the same efficiency as enjoyed by the turret type automatic sheet winding apparatus. During the course of the sheet winding, the sheet on the verge of reaching the growing roll is adjusted to the optimum tension. Thus, the sheet winding apparatus of this invention permits sheet rolls of high quality to be produced with high repeatability.

Compared with the conventional sheet winding apparatus of the type using a stationary type touch roller, the sheet winding apparatus of this invention permits automatic sheet winding to be effected accurately, speedily, and safely with minimum loss of labor and therefore enjoys improvement in terms of both product quality and operational efficiency.

What is claimed is:

1. A sheet winding apparatus comprising:

(a) a rotatable touch roller fixed in place;

(b) a winding core supporting means for supporting winding core at a sheet winding position and releasing the winding core at a sheet roll waiting position after the winding core has had the sheet wound thereabout in the form of a finished sheet roll;

(c) a winding core rotating means for rotating a winding core supported by said winding core supporting means to cause the sheet to be wound about the winding core;

(d) means for stopping supply of the sheet when the sheet has been wound about a winding core to form a finished sheet roll;

(e) means for adjusting the pressure of contact between said touch roller and the sheet at the sheet winding position and, when the sheet has been wound about a winding core in the form of a finished sheet roll, for moving said winding core supporting means from the sheet winding position to the sheet roll waiting position;

(f) a rotary arm means rotatable coaxially with said touch roller for supplying a new winding core to the sheet winding position after said winding core supporting means has moved to the sheet roll waiting position and for holding the sheet between the new winding core and said rotatable touch roller while the sheet is attached to the new winding core;

(g) means for cutting the sheet at the end of each finished sheet roll while the sheet is held between the new winding core and said rotatable touch roller and for causing the cut end of the sheet to adhere to the periphery of the new winding core; and (h) means for causing said winding core supporting means, after having released a winding core having a finished sheet roll wound thereabout, to return to the sheet winding position to support the new winding core and for causing said rotary arm means to release the new winding core, whereby sheet winding is repeated by starting the rotation of the new winding core with said winding core rotating means.

2. A sheet winding apparatus according to claim 1 wherein said touch roller is provided with a speed variation mechanism which allows the peripheral speed of said touch roller to be slightly varied relative to the sheet supplying speed so as to give tension of a prescribed value to the sheet immediately before being wound about a winding core.

3. A sheet winding apparatus according to claim 1 wherein said winding core rotating means is provided with a winding torque adjusting device.

* * * * *